US005173131A

United States Patent [19]

Mantel

[11] Patent Number: 5,173,131

[45] Date of Patent: Dec. 22, 1992

[54] SHAPE MEMORY STAINLESS ALLOY

[75] Inventor: Marc Mantel, Albertville, France

[73] Assignee: Ugine, Aciers De Chatillon Et Gueugnon, Puteaux, France

[21] Appl. No.: 617,032

[22] Filed: Nov. 21, 1990

[30] Foreign Application Priority Data

Nov. 22, 1989 [FR] France ..... 8915341

[51] Int. Cl.[5] ..... C22C 38/38

[52] U.S. Cl. ..... 148/402; 420/56; 420/74

[58] Field of Search ..... 420/56, 74; 148/402

[56] References Cited

U.S. PATENT DOCUMENTS 5,032,195 7/1991 Shin et al. ..... 148/402

FOREIGN PATENT DOCUMENTS 176272 4/1986 European Pat. Off. .
0176272 4/1986 European Pat. Off. ..... 148/402
0692327 5/1940 Fed. Rep. of Germany .
0692732 5/1940 Fed. Rep. of Germany .
0864405 12/1952 Fed. Rep. of Germany .
0439045 11/1935 United Kingdom .

*Primary Examiner*—Deborah Yee
*Attorney, Agent, or Firm*—Cushman, Darby & Cushman

[57] ABSTRACT

Stainless iron-base alloy having a total shape memory effect consisting, after a given cold mechanical deformation, in a recovery of the initial shape by heating, characterized in that its composition by weight is the following:

9 to 13% chromium,
15 to 25% manganese,
3 to 6% silicon, the remainder being iron and residual impurities resulting from the fusion of substances necessasry for producing the alloy, the proportions of the elements satisfying the relation:

$$1.43(\%Si)+1(\%Cr) \leq 17.$$

The invention also provides a method for producing this alloy.

3 Claims, 1 Drawing Sheet

SHAPE MEMORY STAINLESS ALLOY

Figure 1:
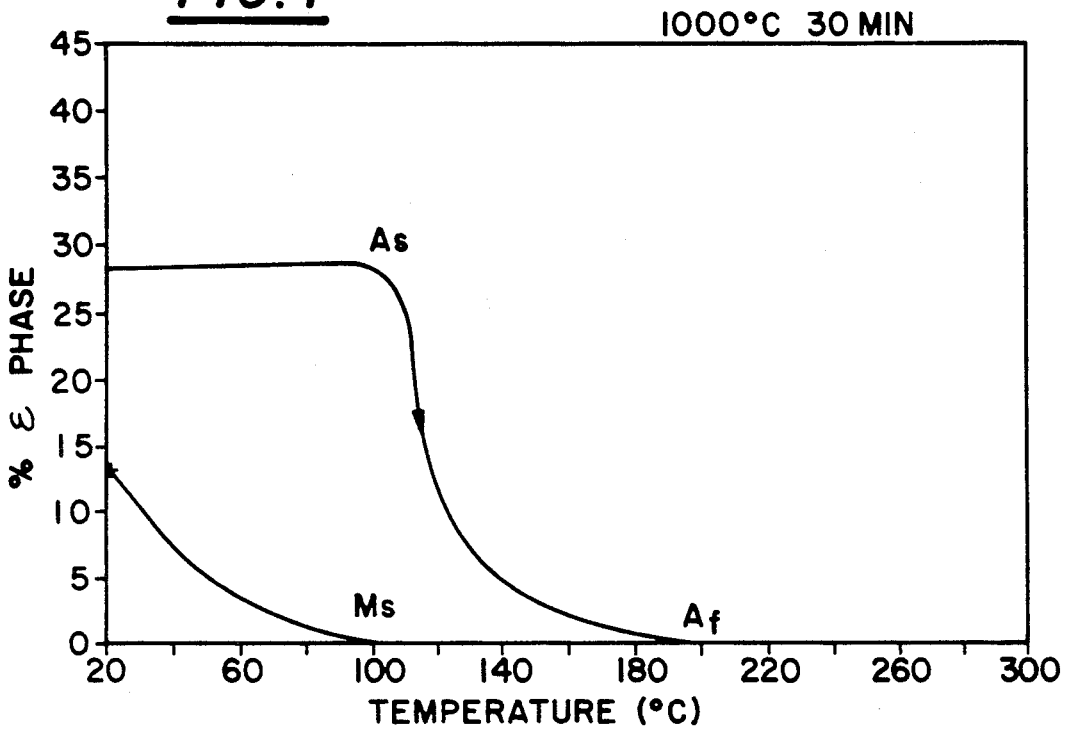

The present invention relates to a stainless or oxidation-resistant iron-base alloy having a shape memory effect consisting in, after a given cold mechanical deformation, a restoration of the initial shape by heating, said shape memory alloy being developed for producing products such as sheets, wires and shapes employed in particular in industrial applications such as tube couplings, sleeves, clamping rings and collars.

The present invention also relates to a method for producing such an alloy.

Shape memory metal alloys have been known for many years and were for a long time considered solely as laboratory products, their production cost being such as not to permit an industrial development thereof to be envisaged.

In recent years, stainless iron-base alloys having a shape memory effect and capable of industrial application have been developed.

In order to avoid the problem of oxidation of such alloys, research has been directed toward the obtainment of shape memory stainless iron-base alloys.

It is known that the shape memory effect is a phenomenon related to the modification in the alloy of an initial austenitic $\gamma$ phase into a martensitic $\epsilon$ phase, which modification is produced in a given temperature range by a given mechanical deformation. The temperature domain in which the $\epsilon$ phase may be created is limited to a temperature range $[M_s, M_5]$ in which $M_s$ is the temperature of the start of the martensitic transformation and $M_f$ the temperature of the finish of the martensitic transformation, the temperature range being generally between $+100°$ C. and $-50°$ C.

The mechanical deformation may be partly or completely removed after heating the deformed alloy at a temperature within a temperature domain in which the martensitic $\epsilon$ phase resumes an austenitic $\gamma$ phase, which temperature domain is limited to an range $[A_s, A_f]$ in which A s is the temperature of the start of the reversion of the martensite and $A_f$ is the temperature of the finish of the reversion of the martensite which temperature range is between 50° C. and 300° C.

The shape memory effect is obtained by promoting the formation of the $\epsilon$ martensite in mechanical deformations.

For this purpose, it is necessary to reduce the stacking fault energy in an austenitic $\gamma$ phase contained in the alloy before the mechanical deformation.

The necessity to reduce the stacking fault energy is related to the crystallographic structures of the $\epsilon$ and $\gamma$ phases. An intrinsic stacking fault in the face-centered cubic structure of the $\gamma$ phase is considered to generate a hexagonal phase or $\epsilon$ phase, the passage from a $\gamma$ phase to a $\epsilon$ phase being obtained by the movement of a Shockley partial dislocation in every other crystalline plane.

An example of the composition of a shape memory alloy is given by the Japanese Patent Application No. 60.249957 and EP-A-176 272.

The alloy comprises:

20 to 40% manganese, 3.5 to 8% silicon, 1 or more constituents such as chromium, nickel, cobalt in an amount less than 10%, less than 2% molybdenum, less than 1% carbon, aluminium and copper.

It is mentioned in this patent application, on one hand, that the $\epsilon$ phase generating the shape memory effect can only be induced with manganese contents of higher than 20% and beyond a manganese content of 40% a phase other than the $\epsilon$ phase predominates with a loss of the memory effect and, on the other hand, that the silicon promotes the creation of the $\epsilon$ phase, the values of contents of silicon higher than 8% resulting in difficulties in the production of the alloy and a loss of the machinability qualities of said alloy.

It is also mentioned in this patent application that the chromium, which enhances the obtainment of the $\epsilon$ phase also creates intermixed compounds having a low melting point which results, with contents higher than 10%, in great difficulty in the production of the alloy. In the described alloy composition, the chromium contents remain lower than 5%.

Although the cited range of the manganese contents is 20 to 40%, it will be observed that the mean value of the manganese contents of the studied alloys set forth in a table showing examples of composition is of the order of 30%. Furthermore, contrary to the teaching, it is also possible to obtain a $\epsilon$ phase in an iron-base alloy when the manganese content is lower than 20% by weight.

The alloy described in the Japanese Patent Application No. 60.249957 is not a stainless or oxidation-resistant alloy and the arguments given with regard to the disclosed contents show that the obtainment of a stainless alloy with such a composition cannot be envisaged.

A shape memory stainless alloy is also known which is sold by the firm NKK Corporation, described in the Patent Application No. EP-A-336 157 and has the following composition:

13 to 15% chromium, 0 to 15% manganese, 0 to 7% silicon, 0 to 10% nickel, to 15% cobalt, elements other than the chromium being adjusted to obtain a shape memory effect by reversion of the martensite phase in a defined range of temperatures between 150° C. and 300° C.

Such an alloy contains a large proportion of nickel and cobalt which are strategic materials whose fluctuating prices dominate the costs of the production of this alloy.

Moreover, when the nickel is added in an amount exceeding 5% by weight, it increases the stacking fault energy whereas the elements such as manganese in a proportion lower than 14.8% and the silicon reduce this energy. Further, the nitrogen is introduced only as an additional alloy element in a proportion corresponding to an order of magnitude of a residual impurity.

Another shape memory alloy is disclosed in the Japanese Patent Application No. 63.216946. In all of the described compositions one, which may be stainless, contains chromium, silicon, 27.4% manganese and imparts to the alloy a restoration rate of 60%.

The invention provides a stainless iron-base alloy having a total shape memory effect consisting, after a given cold mechanical deformation, in a restoration of the initial shape by heating, characterized in that its composition by weight is the following:

9 to 13% chromium, 15 to 25% manganese, 3 to 6% silicon, the remainder being iron and residual impurities resulting from the fusion of substances necessary to the production of the alloy, the proportions of the elements satisfying the relation:

$$1.43\ (\%Si)+1(\%Cr)\leqq 17.$$

According to other features of the invention: the alloy further contains in its composition by weight a nitrogen content of between 0 and 0.3% by weight, the proportions of the elements satisfying the relation:

$$1.43(\%Si)+1(\%Cr)\leqq 19.5\ \leqq 0.66\ \%Mn)+29(\%N),$$

the alloy further contains in its composition by weight a content of nickel element between 0 and 5% by weight, the proportions of the elements satisfying the relation:

$$1.43(\%Si)+1(\%Cr)\leqq 19.5\leqq 0.66(\%Mn)+29(\%N)-+2.1(\%Ni).$$

The range of the chromium contents is determined to protect the alloy against corrosion, i.e. to render it stainless, and the manganese is the principal element favouring the creation of the martensitic $\epsilon$ phase.

The inequalities are justified by the fact that it is necessary to limit the content of alphagenic elements (Cr, Si) in order to avoid the occurrence of a phase rendering the alloy fragile and, moreover, the content of gamagenic elements must be sufficient to impart to the alloy a completely austenitic structure at the temperature of use.

Further, the silicon reduces the stacking fault energy in the austenitic $\gamma$ phase. Moreover, the silicon in the presence of chromium improves the resistance to corrosion of the alloy when its content exceeds or equals 3%.

The nitrogen, whose limit of solubility in the alloy has been found to be about 0.3%, greatly improves the elastic limit of the alloy and in this way promotes the occurrence of the $\epsilon$ phase. The high solubility of the nitrogen in the alloy is related to the presence in said alloy of a relatively high manganese content.

The nitrogen also presents the interest of retarding the precipitation of intermetallic compounds such as the $\sigma$ phase and permitting the addition of chromium in a sufficient amount to impart to the alloy a good resistance to corrosion.

Lastly, the nickel, substituted for the manganese in proportions lower than 5%, does not increase the stacking fault energy and improves the ductility of the alloy.

The nitrogen and the nickel limit the creation of the fragile-rendering $\sigma$ phase and consequently reduce the fragility of the alloy while allowing it to conserves its shape memory properties.

The invention, as opposed to the teaching of the Japanese Patent Application No. 60.249957, permits obtaining an alloy whose chromium content is higher than 6%, the chromium content between 9 and 13% imparting an oxidation-resistant character to the alloy.

The invention also provides a method for producing such a stainless iron-base alloy which has a shape memory effect, from cast ingots, characterized in that said ingots are subjected to different physical and mechanical transformation steps comprising:

forging into flat strips at a temperature of 1150° to 1250° C., grinding for eliminating surface defects, at least one hot rolling at a temperature of 1000° to 1200° C. with a reducing rate exceeding 70%, at least one annealing at a temperature higher than 900° C. for a period of 1 to 30 minutes after each hot rolling, at least one cold rolling with a reducing rate exceeding 50%, and at least one annealing at a temperature of 900° to 1100° C. for a period of 1 to 30 minutes.

According to other features of the invention:

the hot rolling is carried out at a temperature of 1100° C., the annealing, after each hot rolling, is carried out at a temperature of 1000° C. for 20 minutes, the annealing, after each cold rolling, is carried out at a temperature of 1000° C. for 20 minutes.

Figure 2:
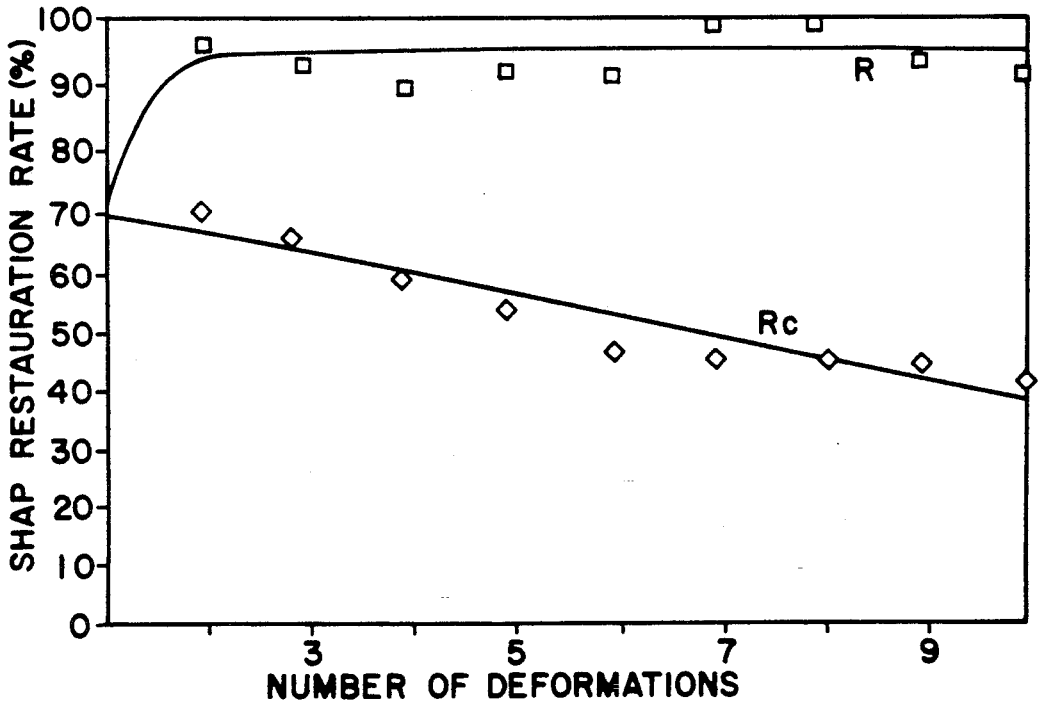

The invention will now be described by means of tests with reference to the accompanying drawings, in which:

FIG. 1 shows a reversion curve of the $\epsilon$ phase measured by X diffraction as a function of the temperature in an example of an alloy composition according to the invention, FIG. 2 shows a group of two curves of deformation and restoration of shape rates in a plurality of successive deformation and reversion cycles, one of the two curves representing the cumulative deformation and shape restoration rates.

The alloy according to the invention is a stainless or oxidation-resistant iron-base alloy said to have a shape memory. This alloy has a shape memory effect, i.e. after a mechanical deformation at room temperature, the alloy completely or partly recovers its initial shape after heating to a temperature within a given range of temperatures which promotes the formation of the austenitic $\gamma$ phase, of face-centred cubic crystalline structure.

The alloy according to the invention is produced from cast ingots whose composition by weight is the following:

22% manganese,

12% chromium,

5% silicon.

Thereafter, the ingots are subjected in accordance with the method of the invention to a forging at 1200° C. into flat strips of 15 mm×100 mm×length. The flat strips are then ground until they reach a thickness of 14 mm to eliminate surface defects.

The flat strips are subjected after forging to a hot rolling at 1100° C. in four steps so as to obtain 1.5 mm thick sheets, then to an annealing at 1000° C. for 20 minutes and lastly to one or more cold rollings respectively followed by an annealing at 1000° C. for 20 minutes.

Knowledge of the temperature of the fragile-rendering phases permitted determining a cycle of treatment of the cast products adapted to obtain a malleable alloy.

After analysis, it is observed that the alloy according to the invention does not contain an $\epsilon$ phase at room temperature.

The $\epsilon$ phase is produced in the alloy by a mechanical deformation of the latter at room temperature. The room temperature is within the range of temperatures within which the $\epsilon$ phase may be created.

FIG. 1 shows a reversion curve of the $\epsilon$ phase.

In a first cycle, the reversion of the $\epsilon$ phase is achieved in the range $[A_s, A_f]$ in which $A_s$ is the temperature of the start of the reversion of the martensite and $A_f$ is the temperature of the finish of the reversion of the martensite.

This range is only slightly different from 100° C. with $A_s$ very slightly different from 100° C. and $A_f$ very slightly different from 200° C.

When cooling, the temperature of the start of the martensitic transformation with $M_s$ only very slightly different from 90° C., and the temperature of the finish of the martensitic transformation $M_f$ is below room temperature. After a few cycles, $M_s$ decreases ($M_s$ very slightly different from 50° C.).

The test specimens employed for showing the deformations due to the shape memory effect have the following dimensions:

1. 5 mm×8 mm×95 mm

A bending deformation by bending on a cylinder or by tension is achieved on each test specimen and the test specimen after deformation is placed in furnaces whose temperature varies in steps of 50° C. between room temperature and 500° C.

In each step, the deformation is calculated after return to room temperature, and it is found that the restoration of the shape occurs between 50° and 200° C.

The test specimen is subjected to a series of deformation-rise in temperature cycles. The test specimen is deformed at room temperature with a constant deformation temperature, then heated to 1000° C. and cooled in air. By measuring the difference between the initial deformation and the final deformation it is possible to determine a restoration percentage.

It is possible to calculate two restoration rates as a function of a number of variable deformation cycles, one in taking for the initial deformation the first deformation of the test specimen (cumulative deformation RC), the other in taking for the initial deformation that achieved after any deformation and restoration cycle (R).

FIG. 2 shows a curve of the deformation and shape restoration rates in a plurality of successive cycles (R) and a curve of the deformation and shape restoration rates which are cumulative after a plurality of cycles (RC).

For an initial deformation of 1.2% after a first cycle, the two restoration rates are close to 70%. In the course of the following cycles, the shape restoration rate remains constant and equal to about 95% while the cumulative shape restoration rate decreases.

As soon as the second cycle is reached, the restoration rate of the test specimen being 94%, it can be considered that the memory effect is total. The restoration rate of 94% is obtained with initial deformation rates of between 0.7% and 3.6%, and the restoration of the initial shape occurs essentially between room temperature and 300° C.

Different alloys according to the invention were produced. The composition by weight of the different ingots is shown in the following Table I.

TABLE I

| Ingots | % by weight | Mn | Cr | Si | Ni | N |
|---|---|---|---|---|---|---|
| 1 | | 22 | 12 | 3 | — | — |
| 2 | | 22 | 12 | 5 | — | — |
| 3 | | 18 | 12 | 5 | 2 | — |
| 4 | | 15 | 10 | 5 | 4.7 | — |
| 5 | | 20 | 9 | 5 | 5 | 1 |
| 6 | | 17 | 10 | 6 | 5 | 0.1 |
| 7 | | 16 | 12 | 4 | 4 | 0.11 |
| 8 | | 22 | 12 | 5 | — | 0.21 |
| 9 | | 16 | 9 | 5 | 4 | — |
| 10 | | 18 | 12 | — | — | — |
| 11 | | 22 | 12 | — | — | — |
| 12 | | 25 | 8 | — | — | — |
| 13 | | 30 | — | 5 | — | — |

Characteristic values of the shape memory alloys are shown in the following Table II.

TABLE II

| Ingots | Ms °C. | As °C. | Def. % | R % after 3 cycles | RC % after 10 cycles |
|---|---|---|---|---|---|
| 1 | 14 | 119 | 3 | 85 | 20 |
| 2 | — | 127 | 3.8 | 94 | 35 |
| 3 | 23 | 136 | 3 | 92 | 33 |
| 4 | — | 123 | 2 | 78 | 29 |
| 5 | 20 | 105 | 3.5 | 93 | 30 |
| 6 | 19 | 115 | 3 | 85 | 29 |
| 7 | 28 | 159 | 3.5 | 88 | 28 |
| 8 | 16 | 112 | 2 | 96 | 45 |
| 9 | 0 | 100 | 3.5 | 95 | 40 |
| 10 | 27 | 93 | 1 | 40 | 5 |
| 11 | 10 | 79 | 0.8 | 60 | 5 |
| 12 | 0 | 88 | 1 | 30 | 0 |
| 13 | 25 | 127 | 3.5 | 95 | 40 |

Ingots 10, 11 and 12 are given as an example and show that the memory effect is improved when the point $M_s$ is just below room temperature.

The limit value of the manganese content, namely 25% by weight in the composition by weight, is defined by the fact that, above this value, with at least 9% chromium and/or nickel, it is difficult to obtain a shape memory effect which is sufficiently large to be industrially exploitable.

Ingot 13 which is also given as an example shows that an improvement in the memory effect is achieved by adding silicon. This effect is evident both in the restoration rate after three shape restoration cycles (R) and after a cumulative shape restoration over ten cycles (RC).

Lastly, it is observed that all the constituent elements of the alloy except silicon reduce the temperature of the martensitic transformation $M_s$.

The silicon has for effect to raise the temperature of this transformation; this special effect of silicon is related to the presence of the manganese and to the fact that the $\epsilon$ martensite is formed with a decrease in the stacking fault energy.

Ingots 3 and 4 show that nickel may be added in an small amount, 2 and 4%, to improve the ductility of the alloy without impairing the memory effect properties.

Ingot 5 shows the positive effect of nitrogen on the shape restoration in the case of a shape restoration cycle (96%) and in the case of a plurality of cumulative shape restoration cycles (45%).

The method for producing the alloy according to the invention permits obtaining a malleable alloy which has a total shape memory effect for a deformation of about 3% per cycle, as shown in the column Def. of Table II, and which may be employed industrially.

The shape memory alloy thus produced may be employed for producing products such as sheets, wires or shapes employed in particular in industrial applications such as tube couplings, sleeves, clamping rings or collars.

What is claimed is:

1. Stainless iron-base alloy having a total shape memory effect comprising, after a given cold mechanical deformation, a restoration of the initial shape by heating, the composition by weight of said alloy being the following:

9 to 13% chromium, 15 to 25% manganese, 3 to 5% silicon, the remainder being iron and residual impurities resulting from fusion of substances necessary for the production of said alloy, the proportions of the elements of said alloy satisfying the relation:

$$1.43(\%Si)+1(\%Cr)\leqq 17$$

2. Stainless alloy according to claim 1, further comprising, in the composition of said alloy by weight, a content of nitrogen of 0 to 0.3% by weight, the proportions of the elements of said alloy satisfying the relation:

$$1.43(\%Si)+1(\%Cr)\leqq 19.5 \leqq 0.66(\%Mn)+29(\%N).$$

3. Stainless alloy according to claim 1, further comprising, in the composition of said alloy by weight, a content of nickel element of 0 to 5% by weight, the proportions of the elements of said alloy satisfying the relation:

$$1.43(\%Si)+1(\%Cr)\leqq 19.5 \leqq 0.66(\%Mn)+29(\%N)+2.1(\%Ni).$$

* * * * *